United States Patent [19]

Mueller

[11] 4,178,970

[45] Dec. 18, 1979

[54] HAND LOOM

[75] Inventor: William F. Mueller, Tarzana, Calif.

[73] Assignee: Christine E. Mueller, Tarzana, Calif.

[21] Appl. No.: 901,355

[22] Filed: May 1, 1978

[51] Int. Cl.[2] ..... D03D 29/00

[52] U.S. Cl. ..... 139/30; 139/33; 139/91

[58] Field of Search ..... 139/29, 30, 31, 32, 139/33, 91, 92, 188, 190; 28/145, 151, 152

[56] References Cited

U.S. PATENT DOCUMENTS

| | | | |
|---|---|---|---|
| 2,556,643 | 6/1951 | Booth | 139/30 |
| 2,619,989 | 12/1952 | Sargent | 139/33 |
| 2,655,947 | 10/1953 | Berglund | 139/30 |
| 2,783,777 | 3/1957 | Bologna et al. | 139/29 |
| 2,803,267 | 8/1957 | Macomber | 139/30 |
| 2,920,657 | 1/1960 | Schraegle | 139/30 |
| 2,960,115 | 11/1960 | Walling | 139/30 |
| 2,974,686 | 3/1961 | Frentzel | 139/29 |

*Primary Examiner*—Henry Jaudon

[57] ABSTRACT

A hand loom of improved and simplified construction in which the course of travel of the warp threads during the weaving operation is similar to conventional looms. However, the loom of the present invention is provided with a beater which is mounted for horizontal reciprocation so that the beater is maintained parallel and square with the warp threads at all times during such reciprocal movement. The beater is mounted directly adjacent the front harness at a point proximate the greatest opening of the shed.

The present loom also has a plurality of harnesses of novel construction, with each of the harnesses being actuated by its own individual lifting means. Thus, a lifting lever, having an elongated arm and an upstanding leg, is positioned beneath each harness and is adapted to raise a selected harness when the outer end of the lever arm is depressed by the operator. Each harness is provided with upper and lower horizontally disposed heddle bars which extend through slots formed in the side rails of the harness and are slidably received in vertical channels in the walls of the castle to guide the harnesses during vertical movement. The loom is constructed so that the number of harnesses in the loom may be varied from two up to sixteen.

The loom may also be provided with means for simultaneously raising alternating harnesses.

15 Claims, 11 Drawing Figures

FIG. 3
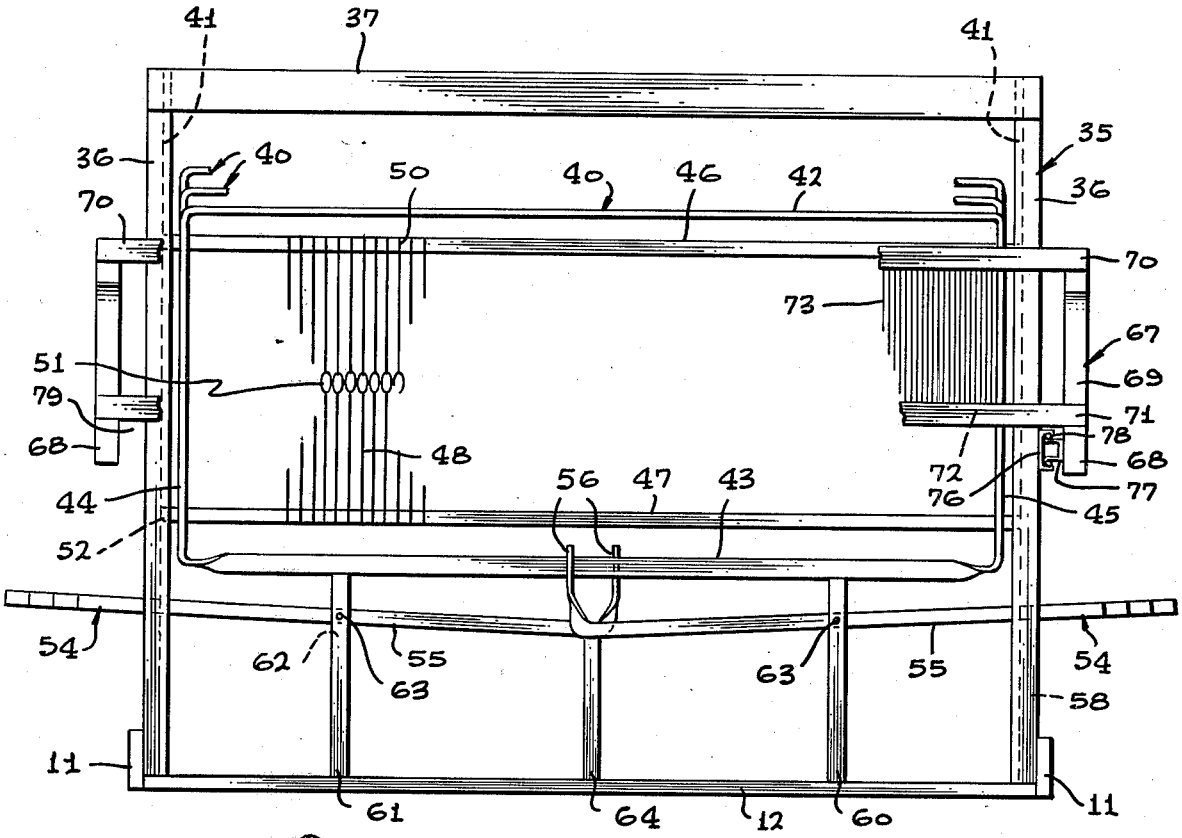
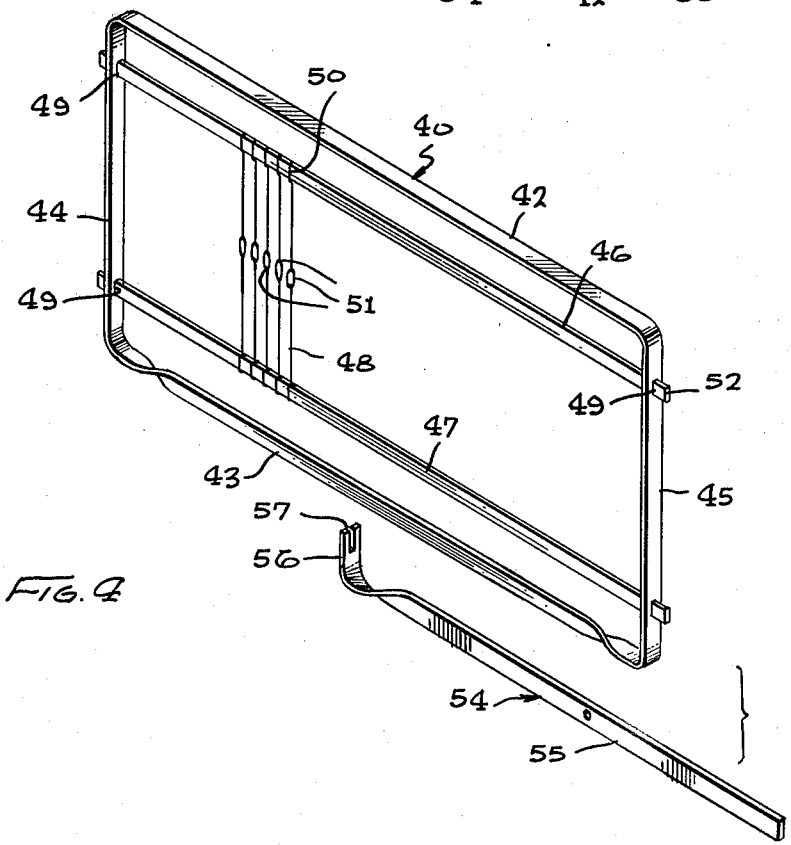
FIG. 4

FIG. 5
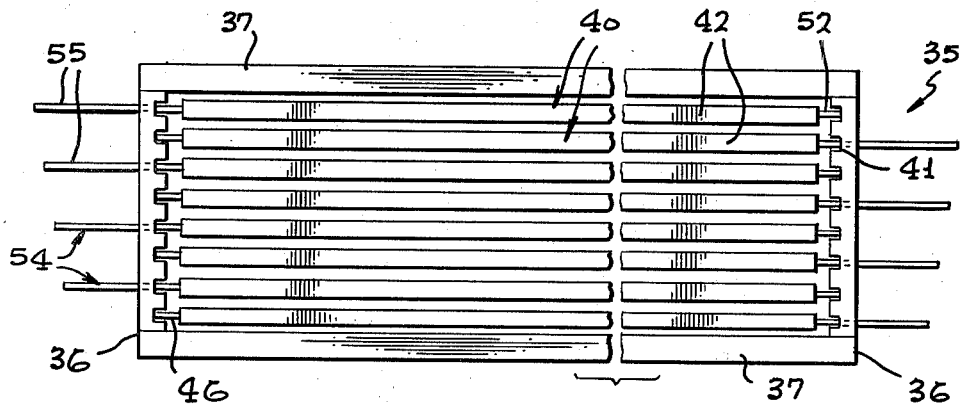
FIG. 6
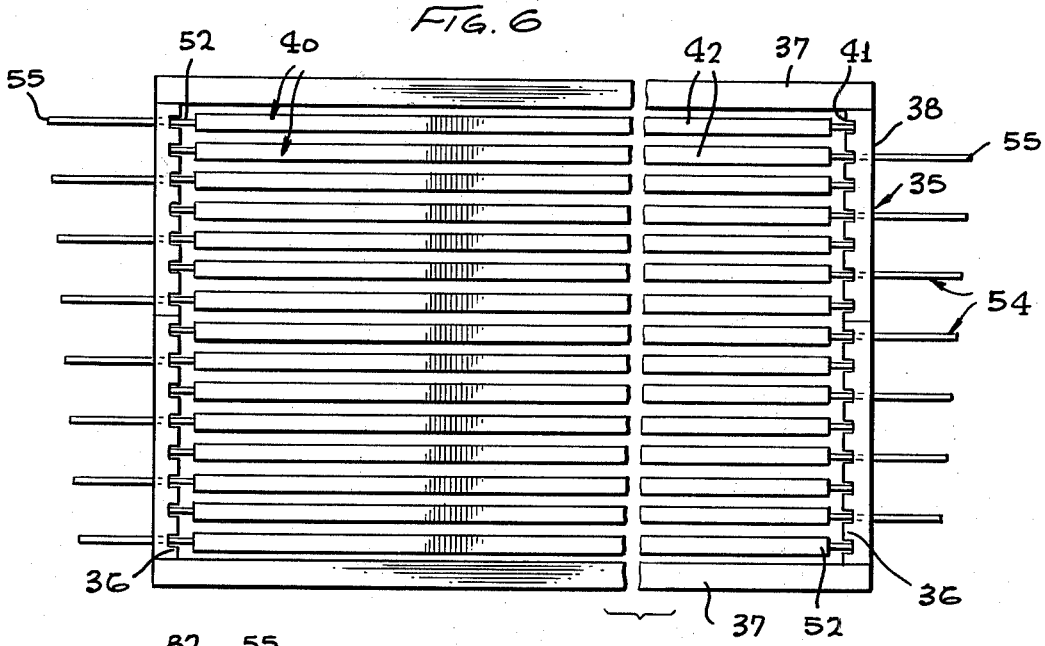
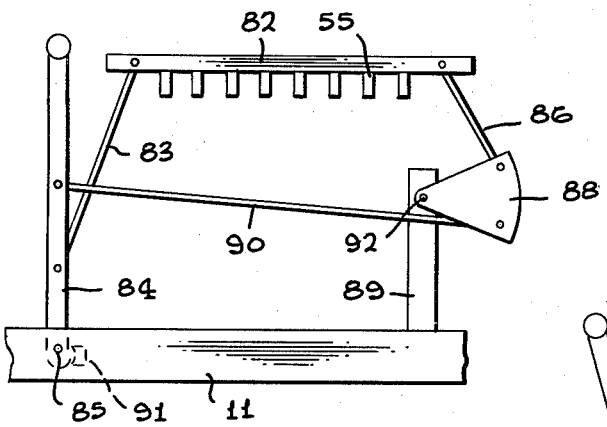
FIG. 7
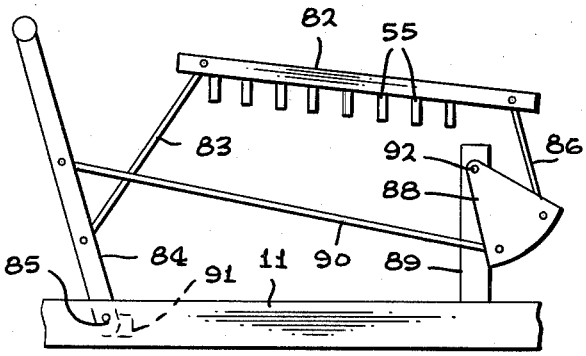
FIG. 8

FIG. 9
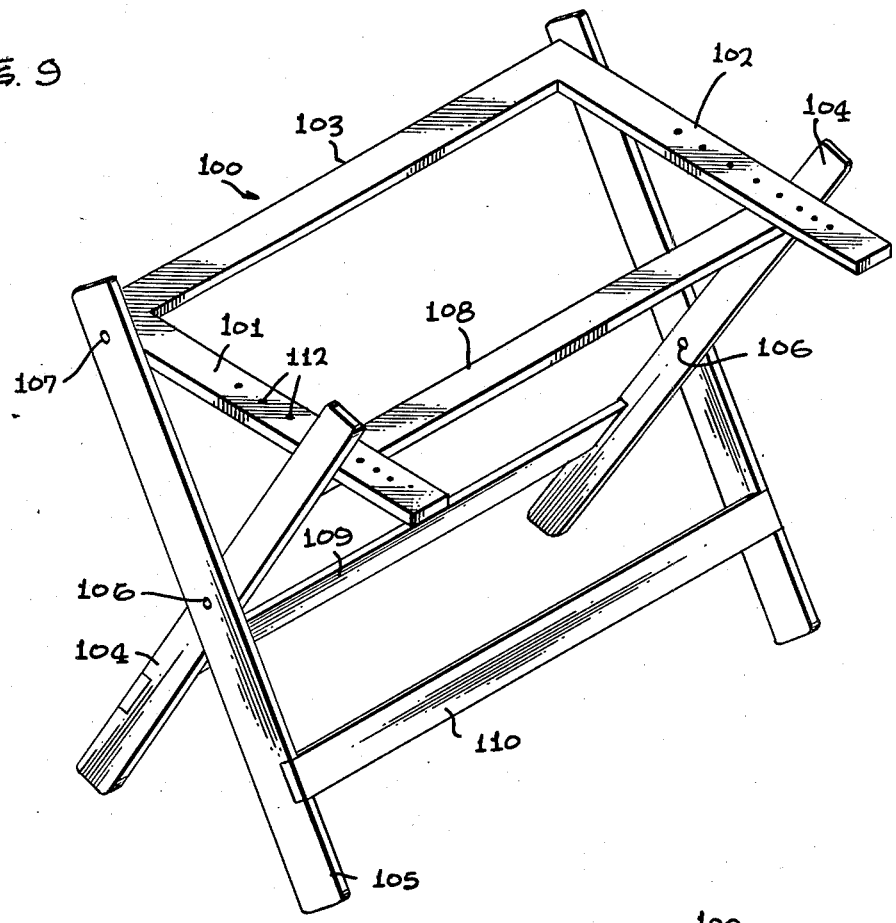
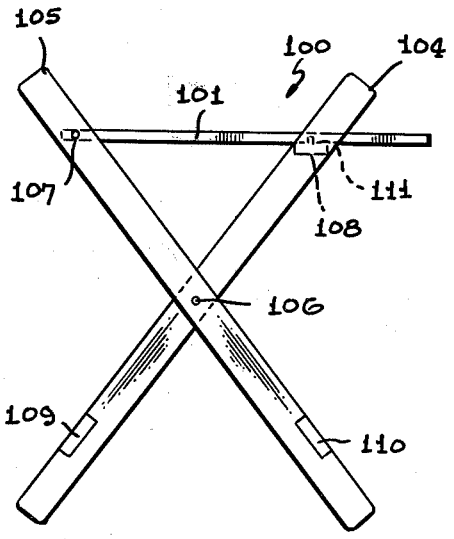
FIG. 10
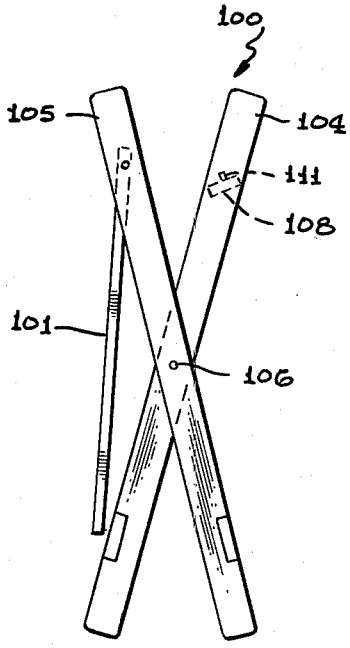
FIG. 11

HAND LOOM

BACKGROUND OF THE INVENTION

This invention relates to hand looms. More particularly, it relates to a hand loom having an improved and simplified construction which is adapted to be mounted on a table, stand bench, and the like for operation.

Hand looms are well known and have been used for many years. Such looms generally consist of a frame, a warp beam at the rear of the frame for holding the warp threads, a cloth beam at the front of the frame upon which the finished fabric is wound, a central harness frame or castle in which a plurality of harnesses are mounted for vertical sliding movement and a beater assembly for forcing laterally extending weft threads tightly against the previously woven portions of the material. Each harness carries a plurality of vertically aligned heddles, each of which has a central eye through which a selected warp thread passes so that the latter can be raised and lowered by the vertically moveable harnesses. The harnesses normally rest in their lower position. During the weaving operation one or more of the harnesses are raised so that the predetermined number of warp threads carried by the raised harnesses are elevated above the remaining warp threads to form an angular, wedge shaped shed between the raised warp threads and the warp threads at rest. A shuttle containing the weft thread is passed through the shed in front of the reed mounted in the beater. The beater is then manually moved forwardly toward the front breast beam to press the weft threads in place. Thus, the actual weaving area is the portion of the loom between the beater and the front breast beam. Accordingly, it is important that the shed formed by raising selected harnesses be of sufficient height in front of the beater to readily permit the shuttle to be passed through the shed.

Prior to the present invention, the beater in hand looms has commonly been pivotally mounted on the frame, usually at the base of the frame, at a point intermediate the castle and the front breast beam. When mounted in this manner, the beater moves in an arc as the operator swings the beater forward against the weft threads during weaving. However, as the beater moves through such an arc, the lower rail of the beater is forced against the warp threads, exerting such an undesirable stress and tension on these threads that the warp threads and woven fabric may be adversely affected. Moreover, when mounted in this manner, the upper portion of the beater rests against the castle so that the reed carried by the beater is spaced some distance, generally 2 inches or more, away from the front harness. Since the height of the shed is greatest at the front harness and tapers downwardly to the point of weaving, it is apparent that such a conventional mounting of the beater does not permit the shuttle to be passed through the shed at the widest opening of the shed. With such a pivotally mounted beater assembly, the operator commonly must pass the shuttle through the shed at a point where the height of the shed is only about one-half inch, making it extremely difficult to pass the shuttle through the shed without hitting and breaking warp threads.

Also in conventional hand looms, the harnesses are commonly raised by a series of cords and pulleys connected to a series of levers which are actuated by the operator, such as by depressing selected treadles mounted in the lower front portion of the loom. However, such prior construction of the harness actuating mechanism is subject to a number of disadvantages. For example, the prior mechanisms for raising selected harnesses during the weaving operation are frequently somewhat cumbersome in use and often result in distortion, canting and uneveness in the lifting of the harnesses and may result in binding of the harnesses. Moreover, in some it necessary to disconnect and/or disassemble the lifting mechanism if a harness is to be removed for any reason, such as heddle changes. Also the mechanism for raising the harnesses in some prior looms requires a force which is frequently so excessive as to unduly fatique the operator.

SUMMARY OF THE INVENTION

The present invention provides a hand loom of improved and simplified construction which is particularly adapted to be mounted on a table, stand, bench, and the like for operation. The loom of this invention is similar to conventional hand looms in so far as the course of travel of the warp threads during weaving is concerned. Thus, the warp threads, which are mounted on a warp beam at the rear of the frame, pass over a rear rail, through the heddles carried on a plurality of harness and through the beater, so that after the transverse weft threads are applied, the finished product comes over the front breast rail and is wound around the cloth beam at the front of the frame.

However, the present invention is directed to a loom construction in which the beater is maintained parallel and square with the warp threads at all times as the beater is moved forward to press the weft threads tightly into position. Also, the beater of the present invention is constructed so that the reed may be positioned directly adjacent the front harness thereby enabling the operator to pass the shuttle through the shed at a point proximate the greatest opening of the shed. The beater of this invention includes two relatively short side arms which are rigidly interconnected by upper and lower cross bars in which a frame, carrying a plurality of closely spaced vertical wires which from the reed, is clamped. The beater is slidably mounted for horizontal reciprocation on the loom frame on a pair of parallel, horizontally extending, telescoping ball bearing slide members at the side of the frame so that the beater may be slidably moved horizontally from a point directly adjacent the harnesses to the front breast rail. This construction eliminates the disadvantages resulting from the pivotal mounting of the beater in prior hand looms, as discussed hereinabove.

The loom of the present inventory also includes a novel harness structure and harness lifting means which enables the harnesses to be readily raised and lowered without distortion, canting or uneveness in the lifting of the harnesses and which requires only a relatively small amount of force to raise the harnesses. Each harness of the present loom comprises top and bottom frame rails, integrally connected by side rails, each of the rails being substantially rectangular in cross-section. The lateral surfaces of the side rails are parallel with the sides of the castle and the lateral surfaces of the bottom rail are normal to that of the side rails. Upper and lower horizontally disposed heddle bars, upon which the heddles are slidably supported, extend through slots formed in the side rails of the harness and are adapted to be slidably received in vertical channels in the side members of the castle to guide the harnesses during vertical reciprocation in the castle.

To accomplish vertical lifting movement of the harnesses there is provided beneath each harness a lifting lever pivotally mounted for rotation about a horizontal axis longitudinal of the loom frame. The lifting lever for each harness includes an elongated arm having integrally formed therewith at its inner end an upstanding leg having a notch provided at its upper end adapted to receive and carry the bottom rail of the harness. The outer end of the lifting lever extends through an elongated vertical slot near the base of the castle. When this outer end of the lever is depressed by the operator, the upstanding leg portion of the lever is pivoted upwardly and laterally to thereby carry the harness upwardly so that the warp threads carried by that harness are raised. Thus, the present invention provides apparatus for directly lifting each harness without the necessity of using conventional cords, chains pulleys, lamms, etc. The loom of the present invention may be provide with up to sixteen harnesses, each actuated by its own individual lifting lever. This construction provides the additional advantage that individual harnesses may be removed, such as for heddle changes, without the necessity of detaching pulleys, cords, chains, lamms, and the like.

Other advantageous features of the invention will be apparent from the following description and claims.

DESCRIPTION OF THE DRAWINGS

Referring more particularly to the accompanying drawings, which are for illustrative purposes only and in which like numerals refer to like parts throughout the several views:

FIG. 3 is a front elevation of the loom, with some parts broken away and some omitted, showing the harness structure and harness lifting means of the loom.

FIG. 4 is an enlarged perspective view of harness structure and harness lifting means of the present invention.

FIG. 5 is a sectional view taken on the line 5—5 of FIG. 2. FIG. 6 is a sectional view taken along lines 6—6 of FIG. 1.

FIG. 7 is a fregmentary side elevation showing a device for simultaneous raising alternate harnesses of the loom.

FIG. 8 is a fragmentary side elevation similar to FIG. 7 but showing the device in a depressed position.

FIG. 9 is a perspective view showing a stand which is particularly well suited for supporting the loom.

FIG. 10 is a side elevation of the stand.

FIG. 11 is a side elevation showing the stand in folded position.

DETAILED DESCRIPTION

Figure 1:
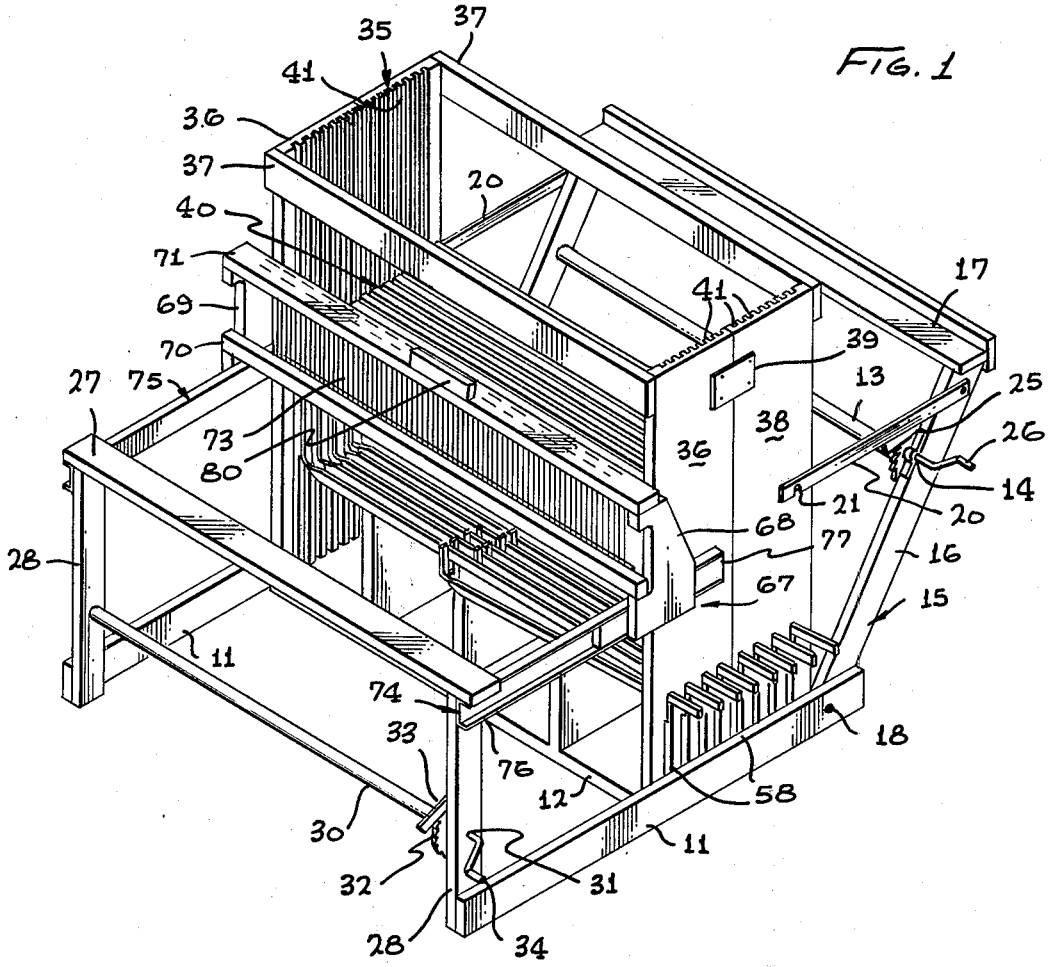
FIG. 1 is a perspective view of the loom of the present invention, with certain portions omitted for clarity of illustration showing a loom provided with sixteen harnesses.

Referring now to the drawings, and more particularly to FIG. 1, the loom of the present invention includes a frame which comprises two laterally-spaced parallel side bars 11 which are rigidly held in predetermined spaced relation by base member 12 secured to the side bars intermediate the ends thereof. A transversely extending warp beam 13, which carries the supply of warp threads, is rotatably carried on a shaft 14 in a pivotally mounted frame 15 comprising a pair of laterally spaced side rails 16 and a top warp rail 17. Side rails 16 are pivotally secured at the rear of each of the side bars 11 by bolts 18. The pivotally mounted frame 15 is maintained in proper angular position with respect to side bars 11 by means of side braces 20, which are secured at one end to side rails 16. The opposing end of the side braces is provided with a notch 21 which is adopted to engage a locking pin 22 on the side of the castle 35. This allows the frame 15 to be folded inwardly for storage or shipping when notch 21 is disengaged from the locking pin, but securely holds the frame in position during such engagement. A ratchet 24 is secured to one outer end of warp beam 13 and a detent pawl 25 is pivotally secured to the side rail 16 adjacent the ratchet, and is maintained in engagement with the ratchet by any suitable means, such as springs (not shown). Alternatively, the pawl may be provided with a slot which is adapted to fit over and engage the ratchet. Thus, the front of the pawl is lifted out of engagement with the ratchet in order to release the ratchet and advance the warp. A hand crank 26 is mounted on the end of shaft 14 adjacent ratchet 24 whereby the warp beam can be rotated to wind thereon the warp threads. The engagement of pawl 25 with ratchet 24 enables such winding but prevents reverse rotation until the pawl is disengaged from the ratchet.

A transversely extending breast beam 27 at the forward end of the loom is secured in position by front vertical support members 28, the lower ends of which are attached to the front end of side bars 11. Cloth beam 30 is rotatably carried on shaft 31 mounted on vertical support members 28. Secured at one end of cloth beam 30 is a ratchet wheel 32 which cooperates with a detent pawl 33 suitably mounted on vertical support member 28 adjacent the ratchet wheel and is maintained in engagement with the ratchet by any suitable means. Carried on shaft 31 is a crank handle 34 by means of which clockwise rotation may be imparted to cloth beam 30 to maintain tension on the threads during the weaving operation and to take up the woven fabric as it is finished. It is to be noted that the front of the loom is open at its bottom portion between the parallel side bars 11 to permit the knees of the operator to be positioned under the front part of the loom for comfort and ease of weaving.

Figure 2:
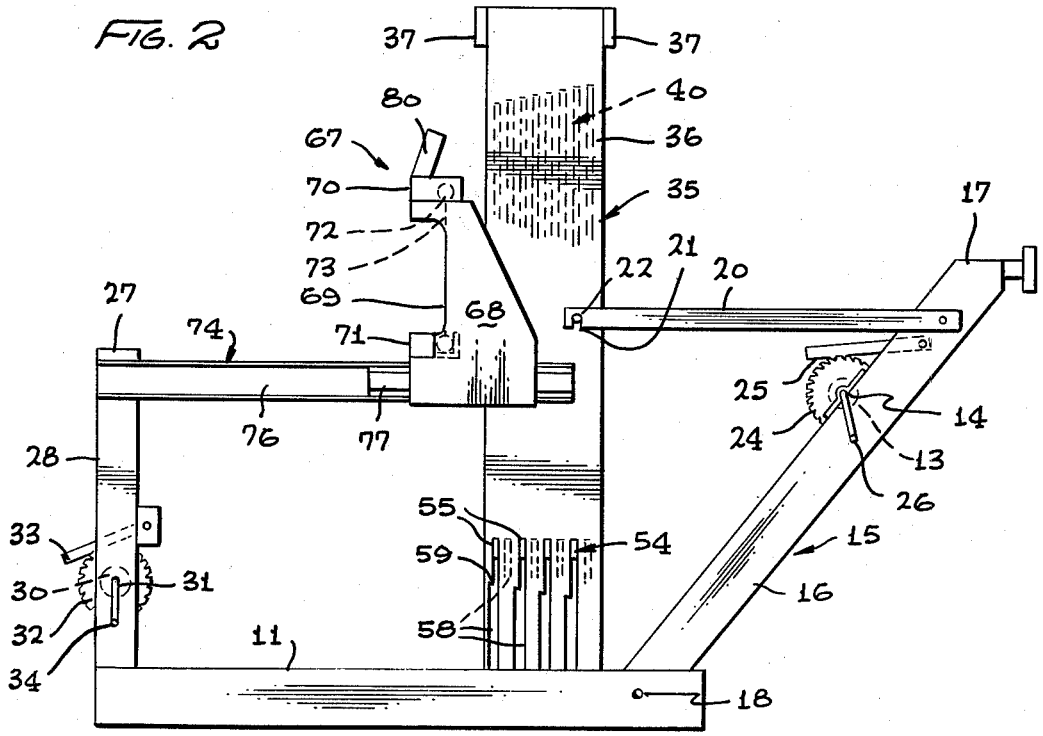
FIG. 2 is a side elevation of the loom, showing the loom provided with eight harnesses.

Located between warp beam 13 and cloth beam 30 and spanning the space between parallel side bars 11 is the castle 35 which comprises two laterally-spaced, parallel vertical side members 36 (FIGS. 2 and 3), the upper ends of which are rigidly interconnected by a pair of cross bars 37 and the lower ends of which are secured to side bars 11 adjacent base member 12. The castle 35 supports a plurality of parallel vertical harnesses 40 for vertical sliding movement. The inner face of both vertical side members 36 of the castle is provided with vertical grooves or channels 41, one for each harness, with the vertical grooves on the opposing side members being aligned to slidably receive and guide the harnesses and to maintain the harnesses in parallel, spaced-apart relation. Preferably, both of the side members of the castle are provided with eight vertical channels 41 so that the castle may accommodate up to eight harnesses, as shown in FIGS. 2 and 5. In accordance with another embodiment of the invention, as shown in FIGS. 1 and 6, a second set of laterally spaced, parallel vertical side members 38, each provided with up to eight aligned vertical channels 41 on their inner faces are secured to side bars 11 in abutting relationship to vertical side members 36 to provide a enlarged castle in which up to sixteen harnesses are slidably mounted for vertical reciprocation. In such an arrangement, plate 39 is secured to the abutting side members 36 and 38 near the upper ends thereof to securely hold the side members in position. Thus, the maximum number of harnesses in the present loom may be increased from eight to sixteen by merely securing the second set of vertical side members 38 in abutting relationship to vertical side members 36.

As shown in FIGS. 3 and 4, the harnesses 40 comprise horizontally disposed, laterally extending parallel top and bottom frame rails 42 and 43 integrally connected by vertically disposed, parallel side rails 44 and 45, with each of the rails being generally rectangular in cross-section. The lateral surfaces of side rails 44 and 45 parallel to and spaced a slight distance inwardly of the inner faces of the vertical side members of the castle. The lateral surfaces of the bottom rail are vertically disposed, so that they are normal to the lateral surfaces of the side rails. Thus, the lateral surfaces of the bottom rail 43 are twisted at right angles to those of side rails 44 and 45. While the lateral surface of the top rail 42 may, if desired, be co-planar with the bottom rail, it is generally preferred that it be horizontally disposed. Upper and lower horizontally disposed heddle bars 46 and 47, upon which heddles 48 are slidably supported by the harness, with heddle bars 46 and 47 being parallel to and in spaced relation to top and bottom frame rails 42 and 43 adjacent the confronting inner faces thereof. The heddle bars 46 and 47 which are substantially rectangular in vertical cross section, are slidably disposed in rectangular slots 49 provided in side rails 44 and 45 near the upper and lower ends thereof, with the ends 52 of the heddle bars 46 and 47 extending a short distance beyond the side rails 44 and 45 of the harness. The ends 52 of the heddle bars are adapted to be slidably received in vertical channels 41 in the side members of the castle 35 to maintain the side rails of the harnesses in parallel relation to and spaced a slight distance inwardly of the inner faces of the side members of the castle. Thus, as shown in FIGS. 5 and 6, only the end portions 52 of heddle bars 46 and 47 which extend beyond side rails 44 and 45 of the harness are disposed in the vertical channels to thereby facilitate vertical reciprocation of the harnesses and guide the harnesses during such vertical reciprocation, while preventing contact of adjacent harnesses.

Each harness carries a plurality of heddles 48 slidably supported on heddle bars 46 and 47. These heddles are formed at each end with eyelets 50 which are adapted to ride loosely on heddle bars 46 and 47, and are provided intemediate their ends with eyelets 51 through which the warp is threaded. Heddle changes may be easily effected by raising a harness out of the aligned channels 41 and slidably removing heddle bars 46 and 47 through slots 49 in that harness.

In order to minimize the height of the projection of the warp threads from the warp beam through the heddles and to the front breast beam, it is important that the longitudinal distance occupied by the harnesses be minimized. Thus, as shown in FIGS. 5 and 6, the harnesses are positioned in close proximity to one another. Moreover, the individual harnesses are relatively narrow compared to conventional harnesses used in prior art looms, having a width of no more than about one-half inch. In order to provide harnesses with sufficient rigidity at such a minimum width, the harnesses preferably are made of metal, such as mild steel.

To accomplish vertical movement of the harnesses 40, each of the harnesses is carried by a lifting lever or jack 54, mounted directly beneath each harness, with the lifting levers being pivotally mounted for rotation about a horizontal axis longitudinal of the frame. The lifting lever 54 which is substantially rectangular in vertical cross-section, includes an elongated arm 55 having integrally formed therewith of its inner end portion an upstanding leg 56. As shown in FIG. 4, the lateral surfaces of the lever arm 55 are co-planar with the lateral surfaces of the bottom rail 43 of the harnesses, while the lateral surfaces of the upstanding leg 56 are normal thereto. The upper end of leg 56 is provided with a rectangular U-shaped notch 57 which is adapted to receive and carry the vertically disposed bottom frame rail 43 of the harness beneath which the lever is mounted. Each lever arm 55 extends laterally from adjacent the mid-point of the harness to a predetermined distance exterior of the side wall of the castle. Thus, the outer end of each lever arm 55 extends through an elongated vertical slot 58 extending through the vertical side members of the castle, upwardly from the base thereof adjacent the harness carried by such lever arm. The slots 58 are vertically aligned with the channels 41 in which the harnesses are vertically received so that a slot 58 is provided adjacent each harness. The slots 58 extend upwardly from the base of the castle to a point below the bottom rail 43 of the harnesses a distance of about the length of upstanding leg 56 of the lifting lever 54. The lever arms mounted below alternate harnesses extended laterally in the same direction, with the lever arms mounted below the intermediate harnesses extending laterally in the opposite direction. Thus, if eight harnesses are mounted in the castle, as shown in FIGS. 2 and 5, four vertical slots 58 are provided through each side member of the castle, adjacent alternate harnesses. Preferably the slots 58 on one side of the castle 35 are disposed below the odd numbered harnesses (i.e. 1,3,5, etc.), while the slots on the opposite side of the castle are disposed below the even numbered harnesses (i.e. 2,4,6, etc.). Each of the slots 58 is provided with a downwardly extending detent notch or keeper 59 adapted to hold the outer end of the lever arm in a depressed position. Thus, when a lever arm is depressed to raise a selected harness, the lever arm is moved laterally a slight distance toward the operator into notch 59 to thereby maintain the lever in a depressed position and the corresponding harness in an raised position while the operator throws the shuttle through the shed formed by the elevated harness.

As shown in FIG. 3, the lifting levers 54 are pivotally mounted on vertical plates 60 and 61 secured to base member 12. The vertical plates 60 and 61 are provided with a series of channels 62 each of which is laterally aligned with a vertical slot 58 in the adjacent side members of the castle. A lever arm 55 extends through each channel 62 and is rotatably mounted on pivot pin 63 which extends horizontally through the channels and lever arms, longitudinal of the loom frame. The upper surface of vertical plates 60 and 61 is adapted to support the harnesses while the harnesses are in their lowermost or resting position. A longitudinally extending support plate 64 is provided intermediate vertical plates 60 and 61 to support the inner ends of lever arm 55. When the outer end of a lever 54 is depressed, the lever pivots around pin 63 to pivotally move the upstanding leg 56 of the lifting lever upwardly and laterally and thereby raise the harness carried by the upstanding leg of that lifting lever.

The lifting lever or jack 54 mounted immediately beneath the forward harness is constructed so as to raise the forward harness a sufficient distance to provide an ample shed, generally between 1½"–2½" in height at the forward harness, so that the shuttle may be readily passed across the loom. The lifting levers mounted beneath each successive harness are so constructed and proportioned so as to raise each successive harness a slight, substantially uniform distance, generally between 1/16"–¼", higher than the preceeding harness. In this manner, the projection of the warp threads from the raised harnesses to the front breast beam is substantially parallel over the width of the loom so that the warp threads forming the raised portion of the shed are substantially co-planar. As shown in FIGS. 1 and 3, the length of each successive lever arm 55 increases slightly from the forward harness to the rearmost harness in the castle. This enables each successive lever arm to be depressed a slightly greater distance than the preceeding lever arm and thereby raises the harnesses carried by the successive lever arms a slight distance higher than the preceeding harness. As shown in FIG. 2, the notch or keeper 59 in the forward vertical slot 58 is positioned to maintain the forward lever arm in a depressed position and the forward harness carried by that lever in an elevated position sufficiently high to provide an ample shed. The keepers 59 provided in each successive slot 58 are positioned slightly lower than the keeper in the preceeding slot, to enable the successive harnesses to be maintained slightly higher than a preceeding harness.

As noted hereinabove, the loom of the present invention includes a beater which is mounted for horizontal reciprocation and is maintained parallel and square to the warp threads at all times the beater is reciprocated. The beater 67 includes two side arms 69, each having a recessed portion 69 on its front face intermediate its top and bottom ends. The side arms are rigidly interconnected by upper and lower cross bars 70 and 71, with cross bar 71 being the race for a shuttle. The confronting faces or upper and lower cross bars 70 and 71 are grooved to receive and clamp to the side arms 68, a hollow rectangular frame 72 carrying a plurality of closely spaced vertical wires 73 which form the reed. To facilitate use of the beater, a suitable handle 80 is secured on upper cross bar 70.

The beater is mounted for horizontal reciprocal movement on a pair of parallel, horizontal, longitudinally extending telescoping ball bearing slides 74 and 75 such as the slides disclosed in U.S. Pat. No. 3,205,025. These slides comprise a pair of slide members, namely, an outer channel member 76, which is secured to and extends between the castle side member 36 and the front support member 28, to rigidly hold the channel member in position, and an inner channel member 77 which is secured to the inner face of a beater side arm 68. The outer and inner channel members 76 and 77 are assembled so that their open sides face each other. Disposed between said channel members is a ball retainer 78 which carries a plurality of ball bearings 79 which are operably positioned in ball races in the inner and outer channel members. The outer and inner channels may be moved longitudinally apart relative to each other, supported by the ball bearing, with a minimum of friction. Thus, the telescoping slides 74 and 75 provide a freely moveable linkage connecting the stationary loom structure with the moveable beater, both being connected to the slides. The channel members 76 and 77 are secured to the loom frame and beater arm at a point such that the upper surface of cross bar 71, which is the race, is substantially co-planar with heddle eyes 51 when the harnesses are at their lowermost or resting position.

Thus the beater of the present invention is mounted for only horizontal reciprocation, is readily moveable, and is maintained parallel and square with the warp threads at all times during such reciprocation. Moreover, as shown in FIG. 1, the beater may be positioned directly adjacent the front harness of the loom, thereby enabling the operator to pass the shuttle through the shed at a point proximate the greatest opening of the shed.

If desired, the loom of the present invention may be provided with means for simultaneously depressing all of the lifting levers or jacks 55 positioned along one side of the castle to enable alternating harnesses to be raised simultaneously. When such means are provided on both sides of the castle, plain or tabby weaving on the loom is facilitated. According to one embodiment, as shown in FIG. 7, a longitudinally extending rigid bar or tube 82 is positioned on the upper surface of all of the lever arms 55 adjacent the inner face of a vertical side member 36, with bar 82 extending the length of the castle. The forward end of bar 82 is pivotally connected to one end of foreward linking bar 83, the opposing end of which is secured to the lower portion of pull back lever 84. The lower end of pull back lever 84 is pivotally secured to side bar 11 of the loom adjacent the front end of vertical side member 36 by suit-able means, such as bolt 85. The rearward end of bar 82 is pivotally connected to the upper end of rear linking bar 86, the lower end of which is secured to concentric 88. The concentric 88 is pivotally mounted for rotation on vertical support bar 89 by suitable means such as bolt 92. The base of support bar 89 is fixedly secured to side bar 11 adjacent the rearward end of vertical side member 36. Lower linking bar 90 extends between and is pivotally secured to the concentric 88 and pull back lever 84 at a point intermediate the ends of lever 84. Suitable locking means 91 are provided adjacent the base of pull back lever 84 to hold the lever in position. As shown in FIG. 8, as the pull back lever 84 is pulled forward and downward, concentric 88 is rotatably moved in a counterclockwise direction, thereby pulling downwardly the rearward end of bar 82.

Simultaneously the forward end of bar 82 is also pulled downwardly. This downward movement of bar 82 moves all of the lever arms 55 on which bar 82 rests in a downward direction thereby raising the harnesses associated with those levers arms. Due to its attachment to the concentric, the rearward end of bar 82 is pulled downwardly a greater distance than is the forward end of the bar so that the distance the levers are depressed increases from the forward end of the bar to its rearward end. In this manner, the distance that the corresponding harnesses are raised increases with each successive harness from the forward end of the castle.

Other suitable means for simultaneously depressing all of the lever arms on one side of the castle may, of course, be provided. Such means preferably are provided on both sides of the castle.

The loom of the present invention is adapted to be mounted on any suitable table, stand, bench or the like for operation. As noted above, unlike conventional looms, the front of the present loom is open at the bottom portion. This permits the knees of the operator to be positioned under the loom for comfort and ease of weaving.

According to a preferred embodiment, the loom is mounted for operation on a stand which is also open at the front end to accommodate the knees of the loom operator. Such a stand is shown in FIGS. 9–11. This stand includes a horizontal, U-shaped support frame 100 consisting of two laterally spaced parallel side arms 101 and 102 rigidly interconnected at their rear portion by cross bar 103. The frame 100 is supported by two pairs of legs, each pair comprising a front leg 104 and a rear leg 105 which are pivotally connected together in X-formation by suitable means, such as bolt 106. The two front legs 104 are rigidly interconnected near their lower ends by cross brace 109, and the two rear legs 105 are similarly rigidly interconnected by cross brace 110. The rear legs 105 are pivotally connected near their upper ends one to each end of cross bar 103, such as by bolt 107. The front legs are also interconnected near their upper ends one to each end of support bar 108 on which side arms 101 and 102 of the support frame rest. Support bar 108 is positioned so that side arms 101 and 102 are substantially horizontal when resting on the upper surface of the support bar. A pin 111 is provided near each end of support bar 108 on the upper surface thereof, the pins being positioned under side arms 101 and 102, and are adapted to fit into one of a series of holes 112 which extend through side arms 101 and 102, to lock the stand securely in position.

Thus, when the Ushaped support frame 100 is lowered to a horizontal position, the pins 111 carried on the upper surface of support bar 108 are inserted into longitudinally aligned holes 112 in the side arms of the frame to securely lock the stand in position. The height of the bench may be readily adjusted. Thus, when the pins are inserted in holes nearer to the closed end of the support frame, the height of the stand is increased. To adjust the height of the bench from a given position, the support frame is lifted off the pins, the legs of the bench are squeezed together slightly, and the support frame is lowered onto longitudinally aligned holes nearer to the closed end of the frame.

The stand may be easily folded into compact form for storage, carrying or shipment. To fold the stand, the support frame is lifted off the pins and rotated around the upper end of rear leg 105. The legs of the stand are then squeezed together into a substantially flat position, as shown in FIG. 11.

Modifications and changes from the specific forms of the invention herein shown and described may be made without departing from the spirit of the invention and such modifications and changes are within the scope of the appended claims.

What is claimed is:

1. In a hand loom having a frame, a warp beam at the rear of the frame, a cloth beam at the front of the frame, a vertically extending castle intermediate the warp beam and the cloth beam in which a plurality of harnesses are mounted for vertical reciprocation and a beater disposed in front of the harnesses, the improvement wherein the harnesses comprise a narrow, rigid generally rectangular frame having laterally spaced parallel side members joined by vertically spaced parallel top and bottom members with the lateral surfaces of the bottom member being twisted at right angles to the lateral surfaces of said side members and have vertically spaced parallel upper and lower heddle bars slidably mounted in and extending between said side members parallel and adjacent to the inner confronting faces of said top and bottom members for carrying a plurality of heddles, said upper and lower heddle bars extending beyond said side members and being adapted to be received in aligned vertical channels provided in the inner confronting surfaces of the castle members, and lever means pivotally mounted for rotation beneath each harness about a horizontal axis longitudinal of the frame, said lever means comprising an elongated arm having an integral upstanding leg at its inner end portion which is in communication with the bottom member of said harness, said leg having a width no greater than the width of said harnesses, and an outer portion extending exterior of the castle, whereby when the said outer portion of the lever means is depressed, the upstanding leg at the inner end portion of the lever means is pivotally moved upwardly and laterally to thereby raise the harness beneath which the said lever means is mounted, the lever means mounted beneath the forward harness of the loom being adapted to raise such harness a sufficient distance to provide an ample shed and the lever means mounted beneath each successive harness being adapted to raise each successive harness a short distance higher than the preceding harness.

2. The loom defined in claim 1 in which the said side members and top and bottom members of the harness are generally rectangular in cross-section, and have a width of no more than about one-half inch with the lateral surfaces of the said side members being parallel to the side walls of the castle and the lateral surfaces of said bottom member being vertically disposed so that they are substantially normal to the lateral surfaces of the said side members.

3. The loom defined in claim 2 in which the lever means is substantially rectangular in cross-section with the lateral surfaces of the elongated arm being co-planar with the lateral surfaces of the bottom member of the harness and the inner end of the lever means is twisted and elevated so that the lateral surfaces of said inner end are at right angles to the lateral surfaces of said inner end is at right angles to the plane of said elongated arm, the upper end of the said upstanding leg being provided with a U-shaped notch in which the bottom member of said harness is disposed.

4. The loom defined in claim 2 in which the said side members of the harness are provided with slots extending therethrough adjacent the upper and lower ends of said side members and the said heddle bars are slidably disposed in and extend between said slots, with the outer ends of said heddle bars extending beyond the side members of the harness.

5. The loom defined in claim 4 in which the inner confronting surfaces of the vertical side walls of the castle are provided with a plurality of parallel, vertically extending, aligned channels, and the said outer ends of the heddle bars extend into said channels whereby the side members of the harnesses are parallel to and spaced inwardly of the inner confronting surfaces of said vertical side members.

6. The loom defined in claim 5 in which each of the vertically extending channels in the side walls of the castle terminates in an elongated vertical slot extending through said castle side wall upwardly from the base thereof to a point adjacent the bottom member of the harnesses, and the outer end portion of the lever means extends through said slot beyond the side wall of the castle a distance sufficient to permit the outer end portion of the lever means to be depressed to thereby raise the harness carried by that lever means.

7. The loom defined in claim 6 in which the vertical slots extending through one side of the castle wall are disposed adjacent alternate harnesses while the slots extending through the side wall of the castle are disposed adjacent intermediate harnesses.

8. The loom defined in claim 6 in which the length of each successive lever means increases from the forward harness to the rearmost harness of the castle whereby the outer end portion of each such successive lever means may be depressed a greater distance than the preceding lever means so that the harness carried by such successive lever means is raised higher than the preceding harness, the lever means mounted beneath the forward harness being adapted to raise such harness a distance of about $1\frac{1}{2}$ to $2\frac{1}{2}$ inches, and the lever means mounted beneath each successive harness being adapted to raise each successive harness a distance of about $\frac{1}{8}$ inch higher than the preceding harness.

9. The loom defined in claim 6 in which each of said vertical slots is provided with a detent notch adapted to hold in a depressed position the outer end of the lever means which extends through said slot, the detent notch adjacent each successive harness from the forward harness to the rearmost harness being positioned a short distance lower than the preceding detent notch.

10. The loom defined in claim 5 in which the castle comprises a first pair of opposing vertical side members secured to the frame, with both of said opposing side members having up to eight parallel, aligned vertically extending channels on the inner confronting surfaces of said vertical side members, said channels extending substantially the entire length of said side members, and being adapted to slidably carry the harnesses in parallel alignment.

11. The loom defined in claim 10 in which a second set of opposing vertical side members, both having up to eight parallel, aligned vertically extending channels on their inner confronting surfaces, are secured to the frame in abutting relationship to said first pair of vertical side members to provide a castle in which up to sixteen harnesses may be slidably mounted.

12. The loom defined in claim 2 in which means are provided for simultaneously depressing all of the lever means extending through one side wall of the castle, said means comprising rigid bar means extending longitudinally over the upper surface of all lever means adjacent a castle wall, handle means pivotally secured to the frame adjacent the front end of the castle, concentric means pivotally mounted on the frame adjacent the rearward end of the castle, first linking means connecting the forward end of the bar means to the handle means near the bottom thereof, second linking means connecting the rearward end of the bar means to the concentric, and third linking means connecting the concentric to the handle means at a point intermediate the ends of the handle means, whereby when the handle means is pulled downwardly, the bar means depresses the lever means, with the distance the lever means is depressed increasing from the forward end to the rearmost end of the castle.

13. The loom defined in claim 1 in which the beater is mounted for substantially horizontal reciprocal movement on parallel, horizontal, longitudinally extending telescoping ball bearing slide members which are secured on opposite sides of the loom frame, said telescoping slide members consisting essentially of an outer channel member secured to the loom frame and an inner channel member secured to the beater and telescopically disposed within said outer channel member, the channel members being assembled so that their open sides face each other and have disposed therebetween a ball retainer which carries a plurality of ball bearings, whereby said inner and outer channel members may be moved apart longitudinally relative to each other supported by the ball bearings.

14. The loom defined in claim 1 in which the frame comprises a pair of laterally spaced parallel side bars which are rigidly interconnected at the forward end of the loom by a transversely extending breast beam, with the forward end of the frame being open at the bottom end thereof.

15. In a hand loom having a frame, a warp beam at the rear of the frame, a cloth beam at the front of the frame, a vertically extending castle intermediate the warp beam and the cloth beam in which a plurality of harnesses are mounted for vertical reciprocation and a beater disposed in front of the harnesses, the improvements wherein the beater is mounted for substantially horizontal reciprocal movement on parallel, horizontal, longitudinally extending telescoping ball bearing slide members which are secured on opposite sides of the loom frame, said telescoping slide members consisting essentially of an outer channel member secured to the loom frame and an inner channel member secured to the beater, the channel members being assembled so that their open sides face each other and have disposed therebetween a ball retainer which carries a plurality of ball bearings, whereby said inner and outer channel members may be moved apart longitudinally relative to each other supported by the ball bearings.

* * * * *